US007320420B2

(12) United States Patent
Buis et al.

(10) Patent No.: US 7,320,420 B2
(45) Date of Patent: Jan. 22, 2008

(54) HOLSTER HOLDER DEVICE

(75) Inventors: Chuck Buis, Virginia Beach, VA (US); Clifton L Cook, Boise, ID (US); Eric M. Yeates, Boise, ID (US)

(73) Assignee: Blackhawk Industries Product Group Unlimited LLC, Norfolk, VA (US)

( * ) Notice: Subject to any disclaimer, the term of this patent is extended or adjusted under 35 U.S.C. 154(b) by 537 days.

(21) Appl. No.: 10/777,859

(22) Filed: Feb. 12, 2004

(65) Prior Publication Data

US 2005/0178808 A1 Aug. 18, 2005

(51) Int. Cl.
*F41C 33/02* (2006.01)

(52) U.S. Cl. ..... 224/197; 224/192; 224/673

(58) Field of Classification Search ..... 224/198, 224/197, 672, 242, 243, 673, 914, 912, 192, 224/195, 911
See application file for complete search history.

(56) References Cited

U.S. PATENT DOCUMENTS 3,589,574 A * 6/1971 Marburger ..... 224/672
3,731,858 A * 5/1973 Baker ..... 224/192
D240,225 S * 6/1976 Baker ..... D3/222
D248,563 S * 7/1978 Baker ..... D3/222
4,504,001 A * 3/1985 Nichols ..... 224/198
4,544,089 A * 10/1985 Tabler ..... 224/192
5,018,653 A * 5/1991 Shoemaker ..... 224/198
5,265,781 A * 11/1993 Nichols ..... 224/198
5,419,472 A * 5/1995 Hellweg et al. ..... 224/198
5,544,794 A 8/1996 Nichols
5,551,611 A 9/1996 Gilmore
5,875,944 A * 3/1999 Beletsky ..... 224/198
6,010,045 A * 1/2000 Rogers et al. ..... 224/198
6,588,639 B2 7/2003 Beletsky et al.
6,588,640 B1 * 7/2003 Rogers et al. ..... 224/673
2004/0188477 A1 * 9/2004 Parsons ..... 224/251

* cited by examiner

*Primary Examiner*—Nathan J. Newhouse
*Assistant Examiner*—Justin M. Larson
(74) *Attorney, Agent, or Firm*—Bowman Green Hampton & Kelly, PLLC

(57) ABSTRACT

An improved holster holding device for fastening a holster onto a wearer includes a belt angle adjustment for changing an angle between a belt and a belt plate. Holster adjustment means for changing an angle between a belt plate or clip-on plate and a holster are included. The holster adjustment includes arcuate slots for accepting fastening devices that fasten the holster to the belt or clip-on plate.

12 Claims, 4 Drawing Sheets

Fig. 4a
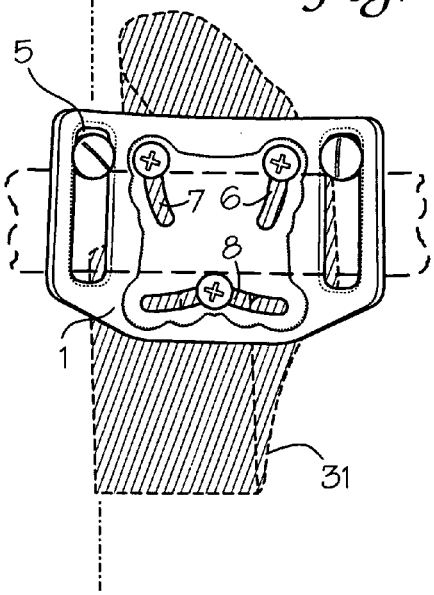
Fig. 4b
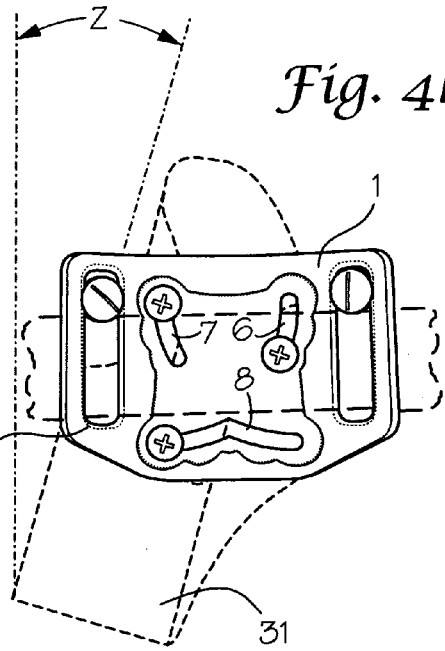
Fig. 5a
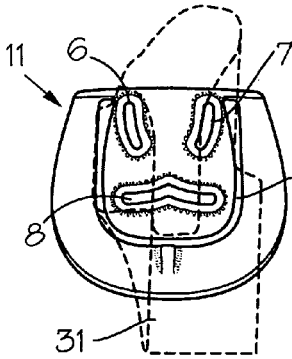
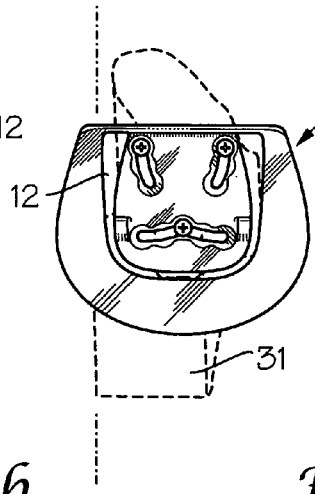
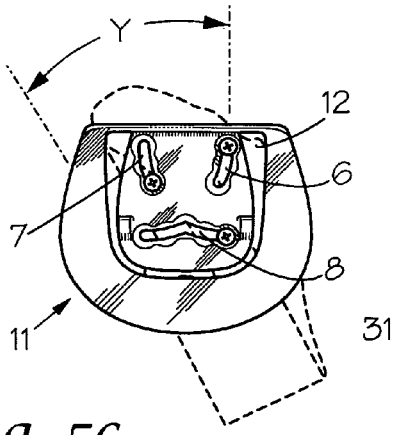
Fig. 5b
Fig. 5c

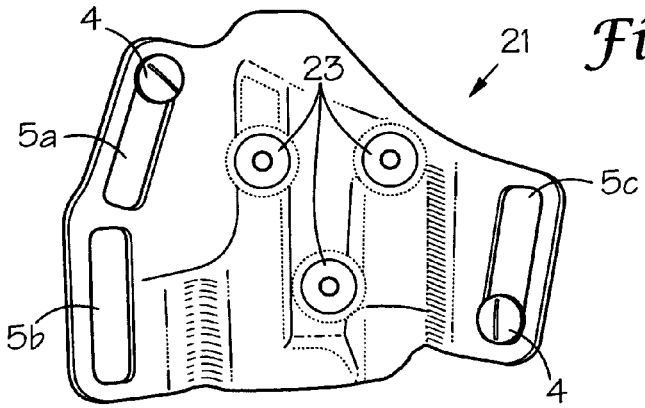
Fig. 6
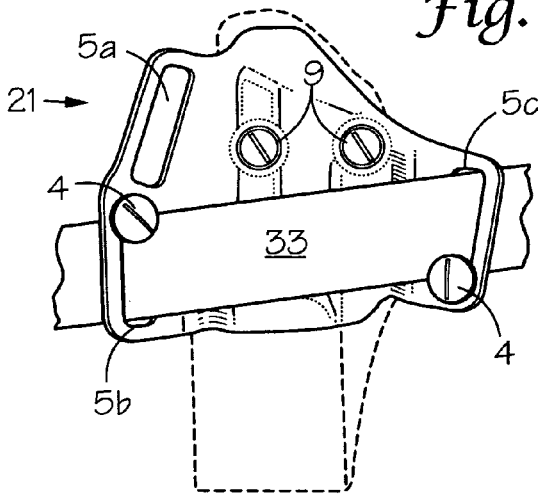
Fig. 7a
Fig. 7b
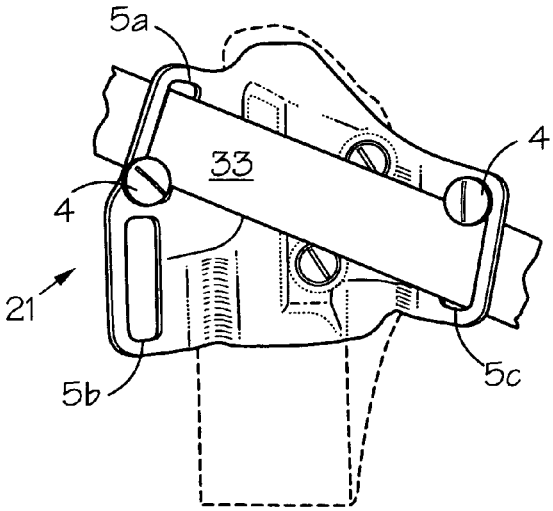

HOLSTER HOLDER DEVICE

There are no related patent applications.

This application was not subject to federal research and development funding.

FIELD OF THE INVENTION

The invention generally relates to a rigid holder for attaching a handgun holster onto a belt, shoulder harness or a waistband of a pair of trousers. More particularly, the holder includes several adjustment points for either changing an angle between the holder and a support belt or for changing the angle at which the holster hangs relative to the holder.

BACKGROUND OF THE INVENTION

There are several types of holster holding devices. For example, U.S. Pat. No. 5,544,794 to Nichols discloses a holster with a hanger device. The hanger device is arranged with bolts such that the height of the holster may be easily adjusted by loosening bolts and moving the holster body up or down relative to the hanger device. After a desired position has been reached, the bolts are tightened to hold the holster at the desired height.

U.S. Pat. No. 5,551,611 to Gilmore discloses a variable position handgun holster with a belt plate and a back plate. The handgun holster may be adjusted longitudinally and radially with respect to the belt plate. The back plate may be adjusted transversally to the belt plate.

U.S. Pat. No. 6,588,639 to Beletsky et al. discloses a molded holster belt loop assembly with a shelf. The belt loop assembly includes a tapered belt loop opening and a platform upon which the belt rests.

None of these prior art references teach a device that is simple to adjust, easy to maintain and cost effective to produce while providing a user with an ability to readily position a holster at a desired angle.

SUMMARY OF THE INVENTION

The invention includes a holder for securing a handgun holster or other such holster onto an article of clothing worn by a user. The holder may be formed of a substantially rigid material such as thermoplastic resin, thermoset plastics, ceramics, composites or any other combination thereof. Typically, the holder is produced through a molding process. The holder may be fastened to a belt, shoulder harness, waistband of a user's pants or other such article of clothing.

A holster attaches to the holder and may be adjustably rotated or twisted to change an angle at which the holster is held relative to the attached article of clothing. That is to say, an angle between the holster and holder may be adjusted or, alternatively, an angle between the holder and the belt may be adjusted.

In a first embodiment, the holder comprises a belt plate including two belt loops for passing a belt therethrough such that the belt is generally perpendicular to the belt plate. Belt angle adjustment means are provided in each belt loop for changing an angle between the belt and the holder. The holder also includes a holster angle adjustment means for varying an angle between the holder and the holster. The holster angle adjustment means includes a pair of formed arcuate slots and a mustache-shaped slot formed by the intersection of two arcuate slots, whose radii have center located above the mustache-shaped slot. Each slot receives a fastener, such as a bolt or screw, that passes therethrough and into the holster for securing it to the holder. These fasteners may be loosened or removed, depending on the size of the screw head relative to the indent formed in the plate wall, and the holster may be twisted to assume a desired angle between the holder and holster. The fasteners are then tightened or replaced to maintain the desired angle.

In a second embodiment, the holder includes a "clip-on" plate or paddle having a biased portion with an extension for securing the holder to a user's belt or waistband. The clip-on plate includes a U-shaped slot for accommodating a waistband, belt, purse strap or the like to secure the plate thereto. As in the first embodiment, arcuate slots and a mustache-shaped slot, receive fastening means for securing the holster to the holder in an adjustable fashion. Thus, in both the first and second embodiments, the holster may be twisted or rotated radially with respect to the holder to allow a user to adjust the angle at which the holster hangs from the wearer. The wearer may adjust the holster such that the handgrip end of the handgun is positioned to hang from the wearer at a desired angle.

In a third embodiment, three belt loops are included in the belt plate for changing an angle between the holder and the belt. Two of the three belt loops are positioned on a side of the holder in a vertical relationship with one above the other. The angle at which the holder hangs relative to the belt may be changed by removing the belt from one of the two vertically related belt loops and passing the belt through the other one.

More specifically, the present invention is directed to a holster holder for securing a holster to a wearer in a desired attitude, the holster holder including a plate, a first arcuate slot defined through the plate with a first fastening means extending therethrough, a second arcuate slot defined through the plate, opposite to the first arcuate slot, with a second fastening means extending therethrough, a third slot defined through the plate below the first and second slots, the third slot having a mustache shape and including a third fastening means extending therethrough, wherein the three fastening means are capable of engaging three points of attachment defined on a holster, and wherein the relative angle of the holster to the plate is adjustable by coordinated adjustment of the three fastening means within each of the three slots. Preferably the fastening means are screws or other commonly employed fasteners.

In one embodiment the holster holder further includes at least two further slots defined through the plate for receiving and securing the plate to a wearer's belt. Preferably, each of the at least two belt receiving slots includes adjustment means for adjusting the height and the angle at which the belt passes through the slot. In another embodiment the plate has at least three belt receiving slots defined therethrough, wherein two of the belt receiving slots are formed in a vertical manner such that one is above the other, thereby providing alternative paths for the belt through the plate, thereby providing for adjustment of the relative angle between the holster holder and the belt. For this embodiment it is also preferred that each of the belt receiving slots includes adjustment means for adjusting the height and the angle at which the belt passes through the slot.

In an alternative embodiment the plate of the holster holder includes a U-shaped slot for attachment of the plate to a portion of the wearer's clothing in a clip-on manner.

Also within the scope of the present invention is a holster holder for securing a holster to a wearer in a desired attitude, which includes a plate, a means for attaching a holster to the plate, at least two slots defined through the plate for receiving and securing a wearer's belt to the plate and adjustment means extending through each slot for adjusting the relative height and angle of the plate with respect to the belt. As above, in another embodiment the plate includes at least three belt receiving slots defined therethrough where two of the belt receiving slots are formed in a vertical manner such that one is above the other, thereby providing alternative paths for the belt through the plate, thereby providing for adjustment of the relative angle between the holster holder and the belt. In a preferred embodiment the means for attaching a holster to the plate is the arrangement of slots for adjustably receiving fasteners described above.

Thus, it is an object of the invention to provide a new and improved holder device for suspending a handgun holster from the waist, hip, leg, shoulder or other such body part of a wearer.

It is another object of the invention to provide a new and improved means for affixing a holster onto a body of a wearer. The means includes a plate with a plurality of adjusting points for allowing the holster to be positioned at a desired angle. In other words, the angle at which the free end of the handgun is orientated relative to the wearer's body may be readily changed.

Additional objects and advantages of the invention will be set forth in part in the description that follows, and in part will be obvious from the description, or may be learned from practicing the invention. The objects and advantages of the invention will be obtained by means of instrumentalities in combinations particularly pointed out in the appended claims.

BRIEF DESCRIPTION OF THE DRAWINGS

FIGS. 4*a* and 4*b* are perspective views of the adjustable position belt plate showing alternative positioning of the holster with respect to the belt plate.

FIGS. 5*a* through 5*c* are perspective views of the holster holder of the second embodiment and showing alternative positioning of the holster with respect to the "clip-on" plate.

FIG. 6 is a perspective view of a third embodiment of a holster holder having an adjustable position belt plate and taken from a side opposite the holster.

FIGS. 7*a* and 7*b* are perspective views of the holster holder of FIG. 6 and showing alternative positioning of the adjustable position belt plate with respect to the belt.

DETAILED DESCRIPTION OF THE INVENTION

Figure 1:
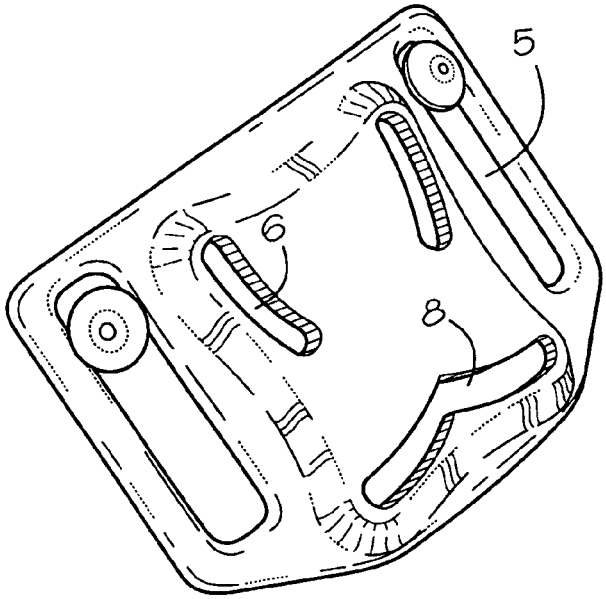
FIG. 1 is a perspective front view of a first embodiment of a holster holder having an adjustable position belt plate and taken from a side nearest the holster. A raised area includes arcuate slots and a mustache shaped slot for adjusting an angle between the belt plate and the holster. Belt adjusting means for adjusting the angle between the belt and the holder are shown. The belt adjusting means may raise or lower the height of the holster relative to the belt.
Figure 2:
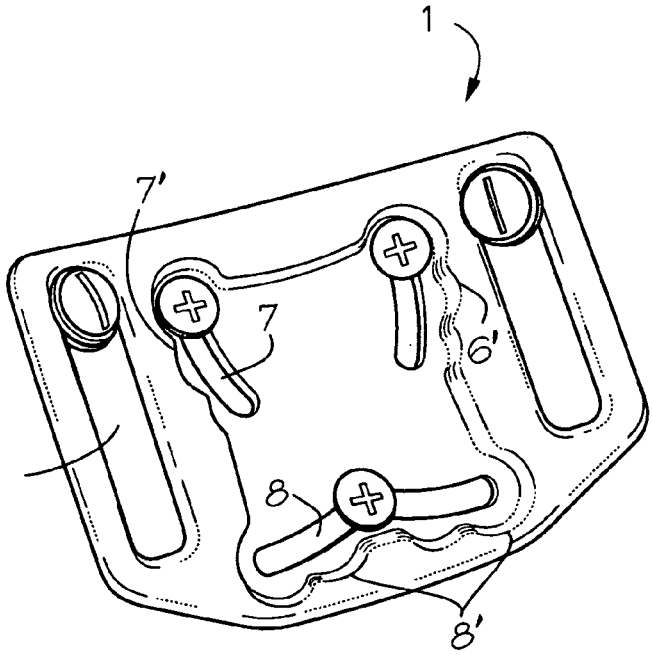
FIG. 2 is a perspective back view of a first embodiment of a holster holder including an adjustable position belt plate and shown from a side that is worn in contact with the wearer.

FIGS. 1 through 4 illustrate a holster holder that comprises a belt plate 1 according to a first embodiment of the invention for suspending a holster 31 from a belt 33 worn by a user. Referring now to FIGS. 1 and 2 that show perspective views of opposite sides of the belt plate 1, the belt plate 1 is formed from substantially rigid material and is generally rectangular in shape with rounded lower corners. The raised area shown in FIG. 1 is important for creating a clearance between the holster and the body of the wearer but not critical for practicing the invention.

The belt plate 1 includes two belt loops 5 for receiving a belt, not shown in FIGS. 1 and 2. Each belt loop 5 includes a belt adjusting means comprising a combination screw 3 and nut 4 assembly that may be readily loosened and tightened to raise and lower the holster, as well as for changing the angle between the belt 33 and the belt plate 1. While the figures illustrate the belt adjusting means as comprising roundhead or button head screws and nuts, it should be noted that various other bolt, screw and nut assemblies might be used to practice the invention. Similarly, while the figures illustrate the engagable screw head facing the wearer's clothing, alternatively, it may face outwardly for adjustment of the holster holder while being worn.

The belt plate 1 also includes a holster angle adjustment means comprising a pair of formed arcuate slots 6, 7 and a mustache-shaped slot 8. Arcuate slots 6 and 7 are mirror images of one another running in a substantially vertical fashion and formed near a top of the belt plate as shown. Mustache-shaped slot 8 is formed near the bottom of the plate 1 and in a substantially horizontal manner. Each slot receives a fastener 9, such as a bolt or screw, that passes therethrough for securing the holster 31 to the belt plate 1. These fasteners 9 may be loosened and the holster may be twisted to assume a desired angle between the belt plate 1 and the holster 31 as depicted in the later views.

As can be seen from a review of FIGS. 2, 4*a*, 4*b*, 5*b*, and 5*c*, preferably the plate about slots 6, 7 and 8 is formed to provide clearly defined beds for the heads of the fasteners. This curvature or indent of the plate wall is referenced at 6', 7' and 8' in FIG. 2 and at 6", 7", and 8" in FIGS. 5*b* and 5*c*. FIG. 2 illustrates an embodiment in which indents are formed about the outer edges of the slots only, while FIGS. 5*b* and 5*c* illustrate the preferred embodiment of fastener positioning indents surrounding the slots. Thus, incremental angles can be achieved by movement of the plate such that the fasteners are seated in positions, which are predefined by the indents. Upon tightening of the holster to the plate by tightening of the fasteners the holster position is fixed. Slippage of the tightened fasteners within the arcuate slots is precluded by the predefined indents. Depending on the relative size of the fastener head, each fastener must be loosened or removed prior to adjustment to another position.

Figure 3A:
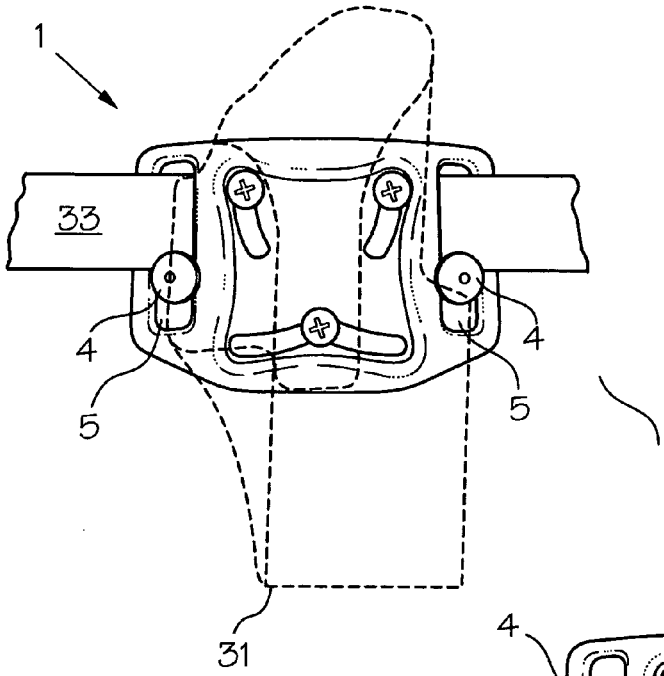
FIGS. 3*a* through 3*c* are perspective views of the adjustable position belt plate depicting alternative positioning of the belt plate with respect to a belt.
Figure 3B:
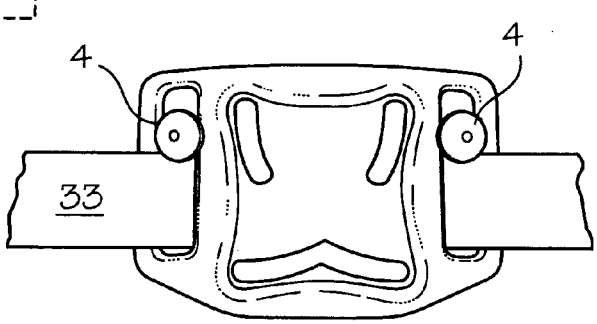
Figure 3C:
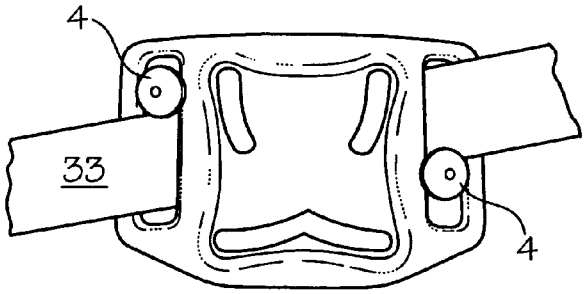

Turning now to FIGS. 3*a* through 3*c* that depict use of the belt adjusting means for varying the height of the holster 31 relative to the belt 33 or changing the angle therebetween. In FIG. 3*a*, holster 31 is depicted in phantom with broken lines. In this figure, the nuts 4 are positioned in the belt slots 5 below the belt 33. This configuration forces the holster 31 upwards causing it to "ride" high on the belt 33. In FIG. 3*b*, the nuts 4 are positioned above the belt 33 to force the holster 31 to "ride" low on the belt 33. In FIG. 3*c*, the nuts 4 are positioned with one being above the belt 33 and the other below the belt 33 to change the angle at which the belt plate 1 is secured relative to the belt 33. Thus, the angle of twist at which the holster is held may be readily varied as shown in FIG. 3*c*.

FIGS. 4*a* and 4*b* illustrate rear side views of the belt plate 1 and having the belt 33 shown in phantom for ease in understanding the invention. The belt plate 1 is adjustable between the positions seen in these figures. With the fasteners 9 loosened, the holster 31 may be adjusted to assume a desired angle Z as shown in FIG. 4*b*. Angle Z illustrates the adjustment of the holster with respect to the belt plate about a longitudinal axis parallel to the belt plate. That is to say, the holster fasteners 9 in the arcuate slots 6, 7 and in mustache-shaped slot 8 may be loosened and rotated within the slots to twist the holster relative to the belt plate 1. It will be appreciated that the previously mentioned adjustments allow the user to position the holster in an infinite number of radial angles with respect to the belt plate. Moreover, it will be readily recognized by a skilled artisan that the adjustments shown in FIGS. 3 and 4 may be undertaken simultaneously to raise or lower the holster while twisting it to a desired angle.

FIGS. 5*a* through 5*c* depict the second embodiment of the invention. In this embodiment, a clip-on plate or paddle 11 includes a U-shaped slot 12 for securing a holster to a waistband, purse strap, belt or other such article of clothing. The clip-on plate 11 includes the arcuate slots 6, 7 and the mustache-shaped slot 8 as shown. The slots form adjustment points for adjusting the holster to a desired angle of twist relative to the clip-on plate. The holster 31 may be twisted or rotated relative to the clip-on plate 11 to assume an angle Y as shown in FIG. 5*c* or angle Z shown in FIG. 4*b*.

FIGS. 6 and 7 depict a third embodiment of the invention. A belt plate 21 includes a pair of vertically arranged belt slots 5*a*, 5*b*. Fastening holes 23 are formed in the belt plate 21 for passing fasteners 9 therethrough and into the holster 31 to secure it to the belt plate 21. As seen in FIGS. 7*a* and 7*b*, the angle at which the belt plate 21 is relative to the belt 33 may be varied by passing the belt 33 through either belt slot 5*a* or 5*b*. This embodiment may also benefit from the height and angle adjustment means disclosed with respect to the embodiment of FIGS. 3 and 4, discussed above.

Thus, the present invention encompasses various combinations of various embodiments. In one aspect the present invention is directed to the adjustable attachment means defined by two arcuate slots and one mustache-shaped slot which receive fasteners for attaching a holster holding plate to a holster, as has been discussed above with respect to FIGS. 1-5. This inventive means for adjustably attaching a holster to a holster holder may be employed on any type of holster holder. Thus, the clip-on plate or paddle disclosed in FIGS. 5*a*- 5*c*, which is itself well known in the art, may advantageously include this inventive adjustable attachment means. Similarly, the inventive holster holder having three, and therefore alternative, belt receiving slots, which is shown in FIGS. 6 and 7 with a conventional means for holster attachment, may also advantageously include the present inventive adjustable attachment means. And, while the inventive holster holder having two belt receiving slots with height and angle adjustment means shown in FIGS. 1-4 is shown with the present preferred adjustable attachment means, it may also be employed with a conventional attachment means such as shown in FIGS. 6 and 7.

While the invention has been described with respect to preferred embodiments, it is apparent to those skilled in the art that changes, modifications and additions may be made to the herein described embodiments without departing from the scope of the invention. Accordingly, it is intended that all matter contained in the above description or shown in the accompanying drawings shall be interpreted as illustrative and not in limiting sense or use.

We claim:

1. A holster holder for securing a holster to a wearer in a desired attitude, the holster holder comprising:

a plate;

a first arcuate slot defined through the plate, wherein the first arcuate slot is capable of allowing a first fastening means to extend therethrough;

a second arcuate slot defined through the plate, wherein the second arcuate slot is capable of allowing a second fastening means to extend therethrough;

a third slot defined through the plate below the first and second slots, the third slot comprising a compound slot formed by the intersection of two arcuate slots, wherein the arc centers of the two arcuate slots are located above the compound slot, wherein a point of intersection of the two arcuate slots forms the highest point of the compound slot, and wherein the third slot is capable of allowing a third fastening means to extend therethrough;

wherein the three fastening means are capable of engaging three points of attachment defined on a holster;

and wherein a relative angle of the holster to the plate is adjustable by coordinated adjustment of the three fastening means within each of the three slots.

2. The holster holder set forth in claim 1 wherein the three fastening means comprise screws.

3. The holster holder set forth in claim 1 further comprising a U-shaped slot for attachment of the plate to a portion of the wearer's clothing in a clip-on manner.

4. The holster holder set forth in claim 1 further comprising at least two further slots defined through the plate for receiving and securing the plate to a wearer's belt.

5. The holster holder set forth in claim 4 wherein each of the at least two belt receiving slots further comprises adjustment means for adjusting the height and the angle at which the belt passes through the slot.

6. The holster holder set forth in claim 1 wherein the holster is adjustable to predefined angles based upon the positioning of the three fastening means in selected indents formed in the plate wall for engaging the fastening means.

7. The holster holder set forth in claim 6 wherein the fastening means comprise screws and wherein the selected indents formed in the plate wall engage the heads of the screws.

8. The holster holder set forth in claim 6 wherein the plate comprises at least three belt receiving slots defined therethrough and wherein two of the belt receiving slots are formed in a vertical manner such that one is above the other, thereby providing alternative paths for the belt through the plate, thereby providing for adjustment of the relative angle between the holster holder and the belt.

9. The holster holder set forth in claim 8 wherein each of the belt receiving slots further comprises adjustment means for adjusting the height and the angle at which the belt passes through the slot.

10. A holster holder for securing a holster to a wearer in a desired attitude, the holster holder comprising:

a plate;

means for attaching a holster to a side of the plate, wherein the means for attaching the holster to the plate comprises a first arcuate slot defined through the plate, wherein the first arcuate slot is capable of allowing a first fastening means to extend therethrough, a second arcuate slot defined through the plate, wherein the second arcuate slot is capable of allowing a second fastening means to extend therethrough, a third slot defined through the plate, below the first and second slots, the third slot comprising a compound slot formed by the intersection of two arcuate slots, wherein the arc centers of the two arcuate slots are located above the compound slot, wherein a point of intersection of the two arcuate slots forms the highest point of the compound slot, and wherein the third slot is capable of allowing a third fastening means to extend therethrough;

at least two slots defined through the plate for receiving and securing a wearer's belt to the plate; and repositionable adjustment means extending through each slot for adjusting a relative height and angle of the plate with respect to the belt.

11. The holster holder set forth in claim 10 wherein the plate comprises at least three belt receiving slots defined therethrough and wherein two of the belt receiving slots are formed in a vertical manner such that one is above the other, thereby providing alternative paths for the belt through the plate, thereby providing for adjustment of the relative angle between the holster holder and the belt.

12. A holster holder for securing a holster to a wearer in a desired attitude, the holster holder comprising:

a plate;

a first arcuate slot defined through the plate, wherein the first arcuate slot is capable of allowing a first fastening means to extend therethrough;

a second arcuate slot defined through the plate, wherein the second arcuate slot is capable of allowing a second fastening means to extend therethrough;

a third slot defined through the plate below the first and second slots, the third slot comprising a compound slot, wherein the compound slot is formed by two intersecting arcuate slots, wherein the arc centers of the arcuate slots are located on the same horizontal plane above the arcuate slots and at points equidistant from, and on opposite sides of, a bisecting vertical centerline, and wherein the radii of the arcuate slots are identical to one another and always greater than or equal to the respective distances between each center and the bisecting centerline and whose point of intersection forms the highest point of the compound slot because the non-intersecting ends of each of the two arcuate slots always terminate when the non-intersecting ends intersect with the vertical centerline of their own centers, and wherein the third slot is capable of allowing a third fastening means to extend therethrough;

wherein the three fastening means are capable of engaging three points of attachment defined on a holster;

and wherein a relative angle of the holster to the plate is adjustable by coordinated adjustment of the three fastening means within each of the three slots.

* * * * *